US005853534A

United States Patent [19]

Höglund et al.

[11] Patent Number: 5,853,534

[45] Date of Patent: Dec. 29, 1998

[54] METHOD OF PRODUCING PULP WITH HIGH YIELD USING A TWO-STAGE REFINING SYSTEM OPERATING AT DIFFERENT TEMPERATURES

[75] Inventors: Hans Höglund, Matfors; Roland Bäck, Njurunda; Ove Danielsson, Stockholm, all of Sweden

[73] Assignee: Sunds Defibrator Industries AB, Sweden

[21] Appl. No.: 932,526

[22] Filed: Sep. 18, 1997

Related U.S. Application Data

[63] Continuation of Ser. No. 464,882, filed as PCT/SE93/01058 Dec. 8, 1993, abandoned.

[30] Foreign Application Priority Data

Dec. 30, 1992 [SE] Sweden ..... 9203943

[51] Int. Cl.[6] ..... D21B 1/02

[52] U.S. Cl. ..... 162/23; 162/24; 162/28

[58] Field of Search ..... 162/23, 24, 26, 162/28

[56] References Cited

U.S. PATENT DOCUMENTS 4,502,918 3/1985 Mackie et al. ..... 162/24

FOREIGN PATENT DOCUMENTS

0138484A2 4/1985 European Pat. Off. .
0284585A2 9/1988 European Pat. Off. .
0413736B1 2/1991 European Pat. Off. .
303088 8/1968 Sweden .
9112367 8/1991 WIPO .

OTHER PUBLICATIONS

G.M. Irvine, "The significance of the glass transition of lignin in thermomechanical pulping", Wood Sci. and Technol. 19(1985). pp. 139–149.

Modern Particle Board & Dry Process Fiberboard Manufacturing, T.M. Freeman, Inc., San Francisco 1977, pp. 238–243.

O. Suchsland and G. Wadson, "Fiberboard Manufacturing Practices", John Wiley & Sons, New York 1991, pp. 65–80.

H.G. Higgins et al., "Conditions for obtaining optimum properties of radiata . . . ", Appita vol. 32, No. 1 Jul. 1978, pp. 23–33.

N.L. Salmen et al., "The Fundamentals of Energy Consumption during Visoelastic and Plastic Deformation of Wood", Transactions of the Technical Section, Canadian Pulp and Paper Association, vol. 83, No. 12 Dec. 1982.

O. Suchsland, "Medium Density Fiberboard", Michigan State University for Tennessee Valley Authority Technical News 1329, Oct. 1978, pp. 23, 26–28 and 40.

R.C. Frances et al., "Thermomechanical Pulping Above the Glass Transaction Temperature", published by ESPRI, pp. 125–140.

W.E. Lunan et al., "High Pressure Refining and Brightening in Thermomechanical Pulping", 1983 Pulping Conference, pp. 239–253.

(List continued on next page.)

*Primary Examiner*—Peter Chin
*Assistant Examiner*—Dean T. Nguyen
*Attorney, Agent, or Firm*—Lerner, David, Littenberg, Krumholz & Mentlik

[57] ABSTRACT

A method of producing mechanical and chemi-mechanical pulp with a yield above 85 % from lignocellulose-containing material for the manufacture of paper or board products. The material is subjected to mechanical processing in at least two steps. The material at its feed into the first step has a temperature below the softening temperature of lignin. When the material is fed into at least one subsequent processing step, it shall have a temperature above the softening temperature of lignin.

21 Claims, 4 Drawing Sheets

OTHER PUBLICATIONS

F. Peng and T. Granfeldt, "Changes in the Microstructure of Spruce Wood Chips After Screw Press Treatment", Journal of Pulp and Paper Science, vol. 22, No. 4, Apr. 1996, P.J140–J146.

1995 International Mechanical Pulping Conference, Jun. 12–15, 1995. Ottawa, Ontario, Canada, pp. 213–225.

Eriksen, J.T. *Consequences Of Chip Quality For Process And Pulp Quality In TMP Production, International Mechanical Pulping Conference 1981*, Oslo, Jun. 16–19, 1981, pp. 1–19.

Gagne et al. *New Challenges For Quebec And Ontario Paper Company LTD., 1991 International Mechanical Pulping Conference,* pp. 263–283.

Goring, D.A.I. *Thermal Softening Of Lignin, Hemicellulose And Cellulose, Physical Chemistry Division, Pulp and Paper Research Institute of Canada,* Dec. 1963, pp. T–517–T–527.

Huusari et al. *An Ideal Combination For Uncoated High Quality Magazine Paper, International Mechanical Pulping Conference,* Toronto, Ontario, Jun. 11–14, 1979, pp. 231–236.

Huusari et al. *Start Up Experiences With The New Tandem TMP Heat Recovery System At Kaipola, International Mechanical Pulping Conference 1981,* Oslo, Jun. 16–19, 1981, pp. 1–19.

Ulander, Eric. *Double Benefit—Economy And Quality—With Twin Refiners At Hylte Bruks AB, International Mechanical Pulping Conference 1985,* Stockholm, Sweden, May 6–10, 1985, pp. 120–127.

METHOD OF PRODUCING PULP WITH HIGH YIELD USING A TWO-STAGE REFINING SYSTEM OPERATING AT DIFFERENT TEMPERATURES

This is a continuation, of application Ser. No. 08/464,882, filed as PCT/SE93/01058 Dec. 8, 1993 now abandoned.

FIELD OF THE INVENTION

This invention relates to the production of mechanical and chemi-mechanical pulp with a yield of above 85% from lignocellulose-containing material for The making of paper or board products.

BACKGROUND OF THE INVENTION

Mechanical pulp (e.g. TMP) or chemi-mechanical pulp (e.g. CTMP) is today produced in several different process variations, where steamed chips are refined in disc refiners of various types. At the production of pulps for different printing papers or wrapping materials, of board type, the refining usually is carried out in one or more steps. The first step normally is pressurized, i.e. the refining takes place at temperatures exceeding 100° C., usually immediately below or at the so-called softening temperature (Tg) of the lignin. Heretofore, it was chosen to hold the pressure and temperature in subsequent refining steps on the same level as in the first refining step, or to carry out later refining steps in systems not pressurized, i.e. at a temperature lower than in the initial step, usually at the softening temperature of the lignin or below the same.

The softening temperature of the lignin, which has proved to be an important variable at the refining of chips in mechanical and chemi-mechanical pulp processes, has been determined in the most recent decades in a number of scientific investigations for a plurality of wood types concerned. At the investigations standard equipment and conventional measuring principles for the determination of viscoelastic parameters have been used. For wood, as for other viscoelastic materials, the softening temperature varies with the load frequency at the measurements. At a higher load frequency, the softening temperature increases. At the processing frequencies normally applied in refiners the softening temperature of coniferous wood was determined to be between 125° C. and 145° C., while it proved to be somewhat lower for our most usual hardwood types. The softening temperature can be shifted by the addition of different chemicals. It can be lowered, for example, after impregnation by usual lignin softening chemicals, of the type sulphite.

Relatively high total electric energy amounts are required for producing the aforementioned types of pulp. The production of pulp for newsprint from coniferous wood, for example, can require up to 2000 kWh/ton pulp. In many studies carried out recently with the object of trying to lower the electric energy consumption in the TMP-process, it was found that the initial processing phase seemed to be quite essential for the total energy consumption in different process variants and for the character of the resulting pulp. This seems to apply in spite of the fact that only a small part of the total electric energy consumption in the refining process is used for the fiber separation proper, i.e. for the conversion from chips to free individual fibers (also called defibering).

A fiber separation energy-effective per se as a result of an effective thermal or chemical softening of the chip areas rich in lignin, however, does not prove to be a guaranty that the total energy consumption will be low. On the contrary, it was proved that TMP-process variants, which were initiated with a mild fiber separation poor in energy, often require a high total energy input.

This circumstance seems to be caused by the fact, that mildly separated but unprocessed fibers, which were obtained by carrying out the defibering at temperatures above the softening temperature of the wood lignin, are difficult to fibrillate during the continued working in the refining process. This fibrillation is necessary for increasing the flexibility or the fibers to a desired level and bringing about the fine material characterizing a good TMP-quality. An intensive processing below the softening temperature of the wood lignin initially and during the continued refining process, on the other hand, easily leads to a deterioration of the long fiber content and thereby of the strength properties of the pulp. This is in many cases unacceptable from a quality point of view. A decrease in the energy consumption from an established level in the TMP-process, as a rule, has been associated with a deterioration of certain quality properties of the resulting pulp, for example lower long fiber contant, lower tear strength, lower tensile strength and higher shives content. The present high energy consumption in the TMP- and CTMP-process, therefore, has been necessary for achieving the desired pulp properties.

SUMMARY OF THE INVENTION

It was now found by surprise, that it is possible to combine low energy consumption in a mechanical or chemi-mechanical pulp making process with maintained quality properties. The present invention relates to such a method, where the mechanical processing, for example refining, takes place in at least two steps. According to the invention, the material at its feed into the first processing step has a temperature below the softening temperature of the lignin, and at its feed into at least one subsequent processing step has a temperature exceeding the softening temperature of the lignin. The invention is described in greater detail in the following, with reference to some expedient embodiments and examples with associated FIGS. 1–8.

DETAILED DESCRIPTION OF THE PREFERRED EMBODIMENTS

Figure 1:
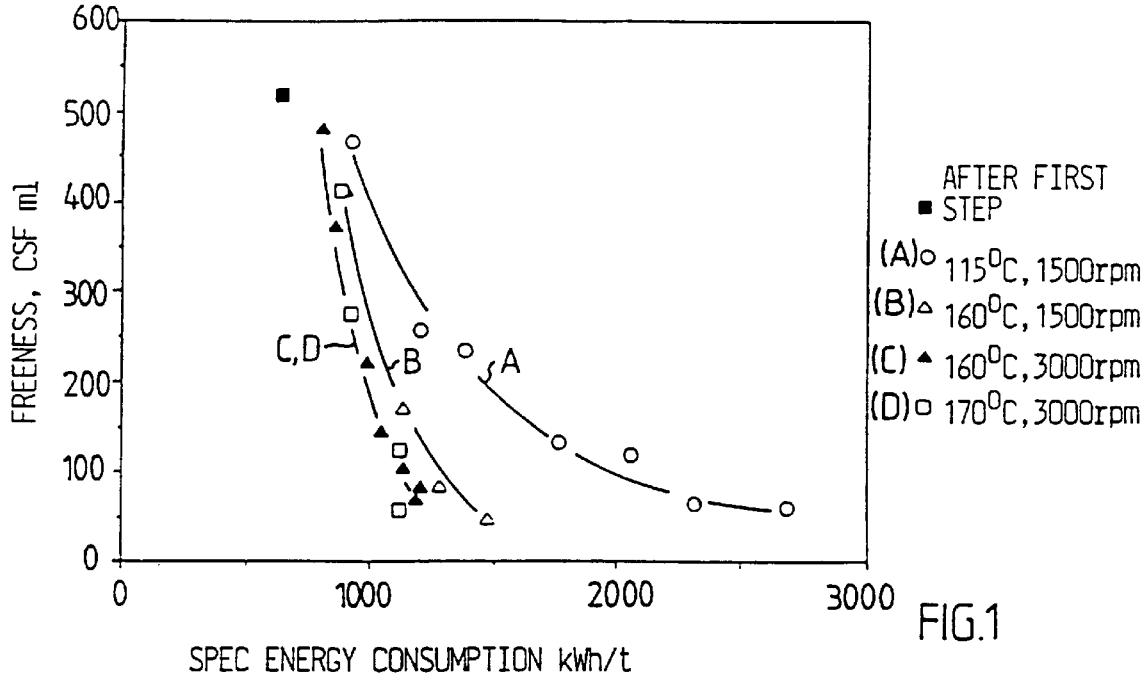
FIG. 1 is a graph of freeness as a function of energy consumption.
Figure 2:
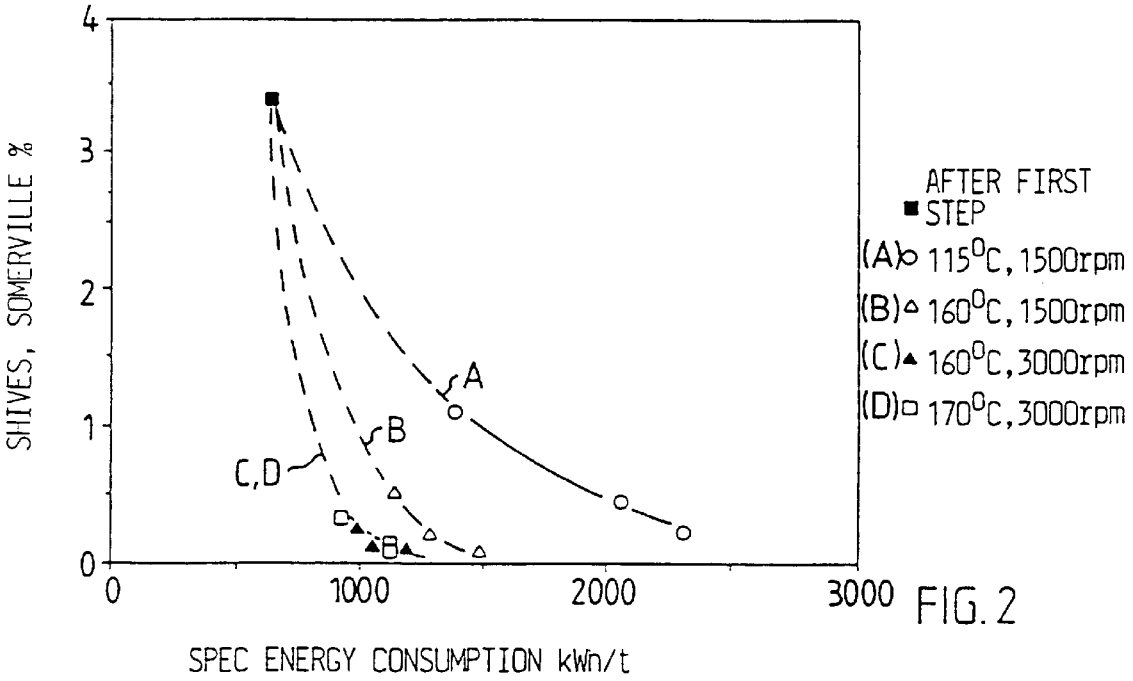
FIG. 2 is a graph of shives content as a function of energy consumption.
Figure 3:
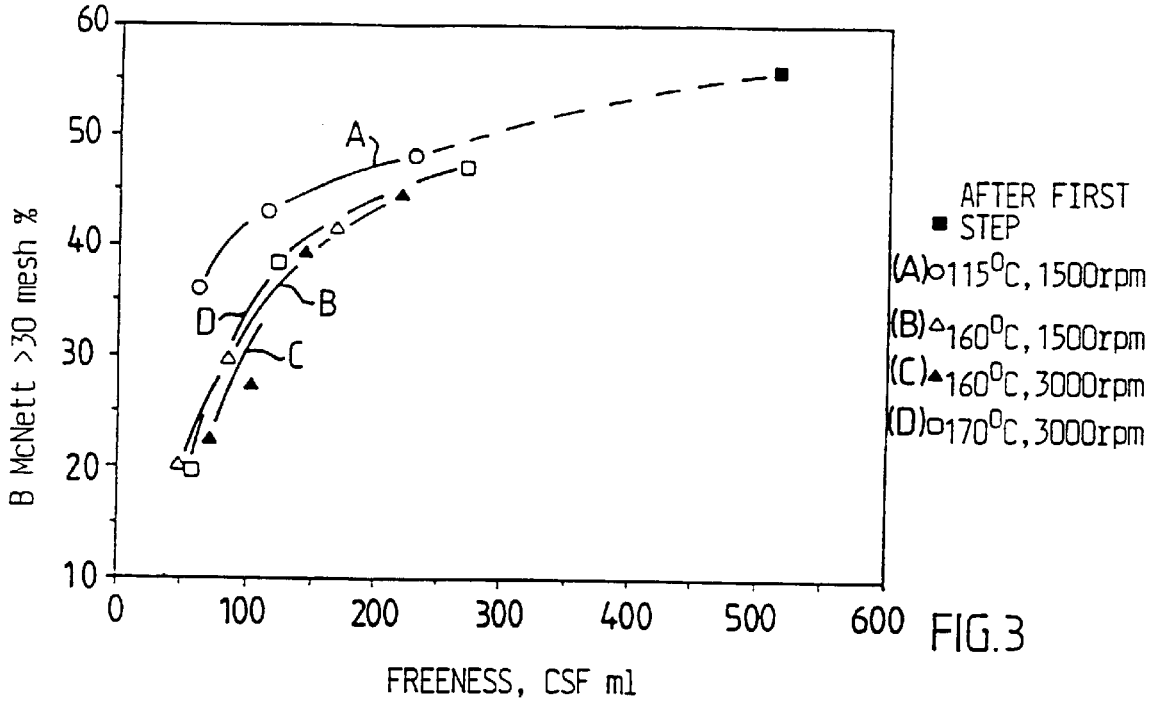
FIG. 3 is a graph of the long fiber content of the pulp as a function of freeness.
Figure 4:
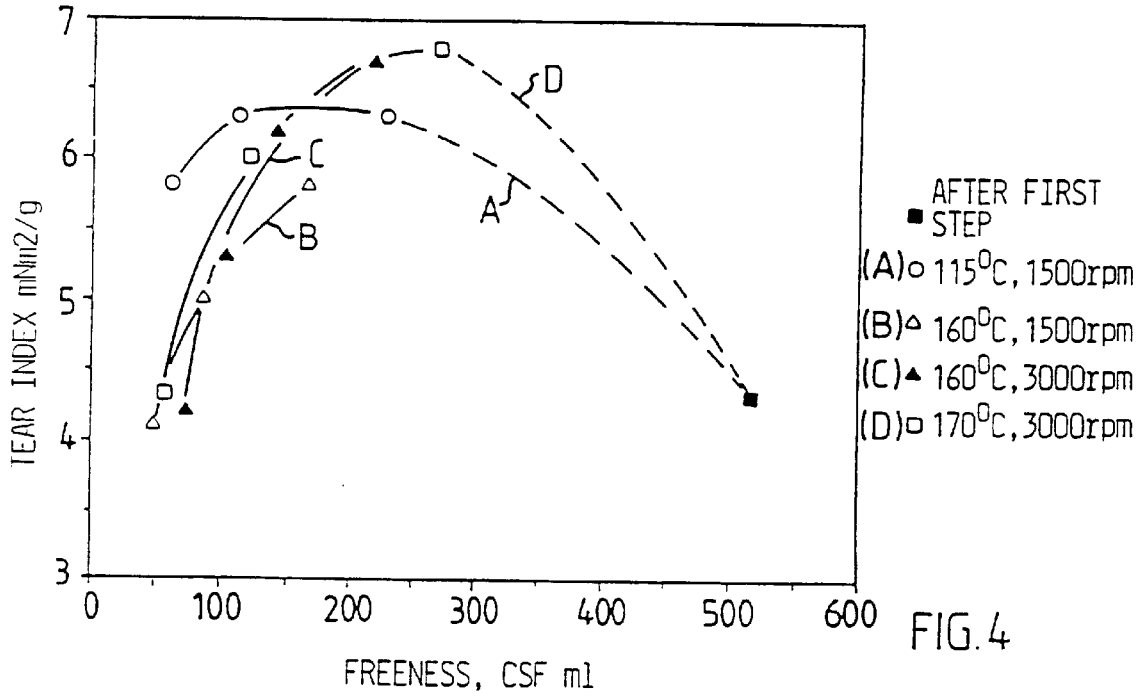
FIG. 4 is a graph of the tear index of the pulp as a function of freeness.

In a TMP-process according to the invention, refining takes place in at least two steps. In the first step the chips are fed into the refiner at a temperature below the softening temperature of the lignin and then are processed under relatively intensive conditions, for example in a double-disc refiner with a speed of at least 1200 rpm or in a single-disc refiner with high relative speed between the refiner discs (at least 1800 rpm, preferably at least 2400 rpm). The energy input in the first step is chosen to be on such a low level, that the long fiber content of the pulp which a.o. yields the potential for the later strength development at the refining, is not deteriorated appreciably. The freenes (CSF) of the pulp after the first step, therefore, shall be high, preferably >500 ml. A subsequent refining step is carried out under conditions where the lignin of the fiber material is well softened. The fiber material then is fed into the refiner at a temperature exceeding the softening temperature of the lignin. In cases when the material consists of coniferous wood not treated with chemicals, the temperature should exceed 150° C., suitably 160° C. and preferably 170° C. When the material is treated with chemicals, the temperature should exceed 135° C., suitably 150° C. and preferably 160° C. As regards an upper temperature limit, temperatures over 200° C. should be avoided, a.o. with regard to dark colouring of the fiber material. The processing frequency preferably can be high (relative speed at least 2400 rpm) at the processing of the well-softened fiber material, which has proved especially favourable from an energy point of view.

The temperature difference between the temperatures of the material at its feed into the first and, respectively, a subsequent processing step should be at least 15° C., suitably at least 25° C. and preferably at least 35° C.

In a process according to the invention fractures and fracture indications in the material initially are guided to layers in the fiber wall not rich in lignin. During the final refining the known fact then can be utilized, that the fiber material can be separated with low energy inputs in areas rich in lignin at temperatures above the softening temperature of the wood lignin. The fractures initially having been guided to areas not rich in lignin, it is thereby avoided to obtain a fiber material with only lignin-covered surfaces which are difficult to fibrillate. This has previously been the great problem when it was tried to utilize refining temperatures above the softening temperature of the lignin at the production of mechanical pulps for printing paper or board products. Fine material from areas between the initial fracture zone and the middle lamina of the fiber rich in lignin also is easily released at temperatures above the softening temperature of the lignin in the later refining step, which can explain the low total energy consumption to a certain freeness (CSF) in this process step and in the entire process according to the invention. The production of fine material otherwise is the most energy requiring part of the mechanical pulp process using conventional technique.

EXAMPLE

Thermomechahical pulp from spruce chips was produced after refining in two steps in a 20" single-disc refiner of a well-equipped test plant. The first refining step (defibering) was carried out after preheating the chips at 115° C. for about 3 minutes, i.e. at a temperature below the softening temperature of the lignin. The refiner was driven by a 3000 rpm motor, in order to ensure that the initial defibering should not take place under too mild conditions. The effect input in the first step was 640 kWh/t, which yielded a pulp with freeness (CSF) 518 ml. In the second refining step the conditions were varied according to the following Table:

| Test | Preheating time min | Refining temperature °C. x) | Motor speed rpm |
|---|---|---|---|
| A | about 1 | 115 ( < Tg) | 1500 |
| B | " | 160 ( > Tg) | 1500 |
| C | " | 160 ( > Tg) | 3000 |
| D | " | 170 ( > Tg) | 3000 |

x) Temperature at preheating and at feed into the refiner

The effect of the varying conditions is shown in FIGS. 1–6 where the most essential pulp properties have been valued, and are commented on as follows:

FIG. 1 shows freeness as a function of energy consumption. It appears that by carrying out the second refining step at temperatures above the softening temperature of the lignin the energy input at refining to a certain freeness can be reduced considerably compared to conventional second step refining at temperatures below the softening temperature of the lignin (compare Tests A and B).The energy reduction will be still greater when, in addition, the speed is increased from 1500 to 3000 rpm (compare Test B with Tests C and D).

FIG. 2 shows the shives content as a function of the energy consumption. It appears that second step refining at temperatures above the softening temperature of the lignin yields a clearly lower shives content at a certain energy input than refining at a temperature below the softening temperature of the lignin (compare Test A with Tests B–D). Also in this case the higher speed yields the most favourable values. This proves to be a further advantage by using the conditions according to the invention.

FIG. 3 shows the long fiber content as a function of freeness. It appears that the long fiber content of the pulp generally can be maintained all the way down to the freeness range 150–200 ml, in spite of the heavy energy reduction at refining according to the conditions of the invention.

FIG. 4 shows the tear index as a function of freeness. It appears that the tear index of the pulp can be maintained all the way down to the freeness range 150–200 ml, in spite of the large energy reduction at refining at the conditions of the invention.

Figure 5:
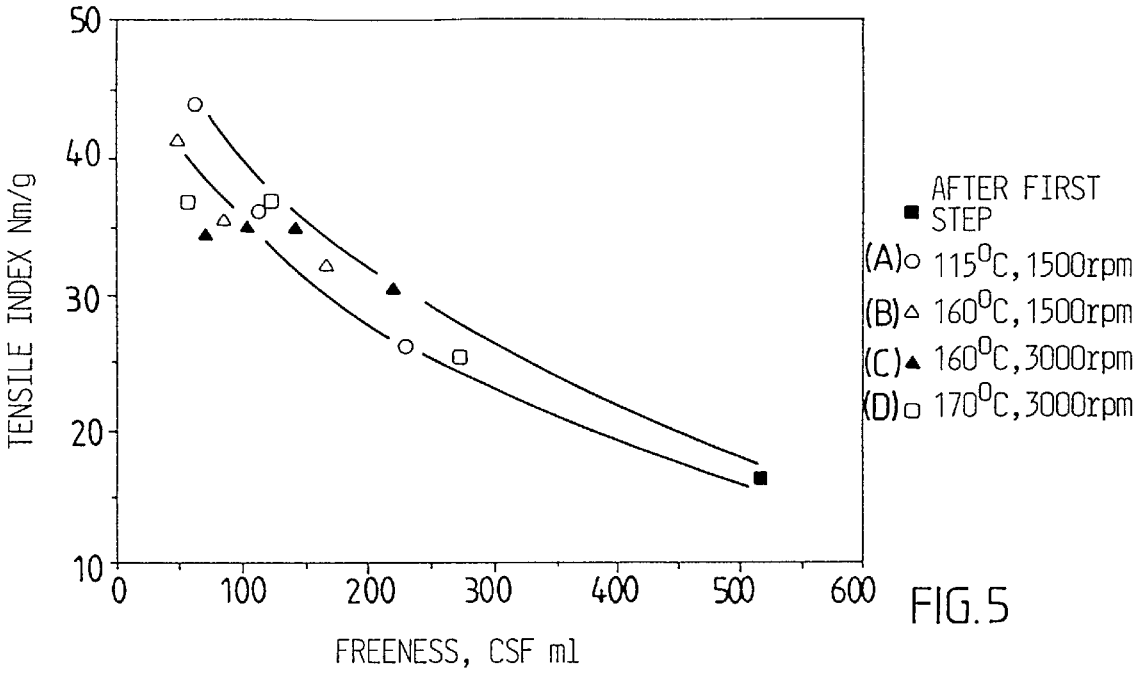
FIG. 5 is a graph of the tensile index of the pulp as a function of freeness.
Figure 6:
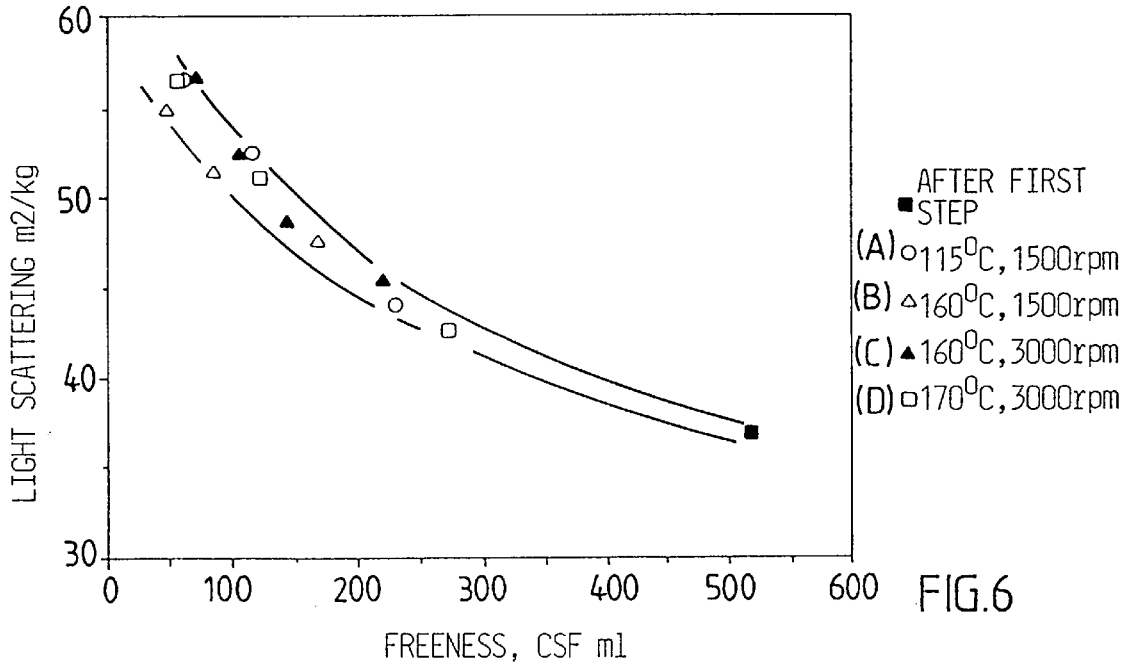
FIG. 6 is a graph of the light scattering coefficient of the pulp as a function of freeness.

FIGS. 5 and 6 show the tensile index and, respectively, light scattering as a function of freeness. It appears that all tested pulps develop tensile index and, respectively, light scattering coefficient in a similar way when they are valued conventionally against freeness.

In parallel with the tests described and with reference thereto it also was investigated, how energy consumption and pulp quality are affected when a refining process contrary to the conditions of the invention was started with a refining step where the temperature at the feed to the first step refiner is higher than the softening temperature of the lignin. Also in this case the thermomechanical pulp was made from spruce chips after refining in two steps by single-disc refiners. The first refining step was carried out at temperatures above the softening temperature of the lignin in the same equipment which was used previously in the test. The conditions in the first refining step and the freeness after refining with a certain energy input are described in the following Table:

| Test | Preheating time, min | Refining temp. °C. x) | Motor speed rpm | Energy input kWh/t | Freeness ml |
|---|---|---|---|---|---|
| E | about 1 | 150 ( > Tg) | 3000 | 940 | 450 |
| F | " | 160 ( > Tg) | 1500 | 900 | 580 |
| G | " | 160 ( > Tg) | 3000 | 790 | 415 |

x) Temperature at preheating and feed into the refiner

In a second refining step which was carried out under atmospheric conditions in a 20" refiner, i.e. at temperatures below the softening temperature of lignin, the freeness was lowered to an interesting range for printing paper pulps. The refiner speed in this case was 1500 rpm.

Figure 7:
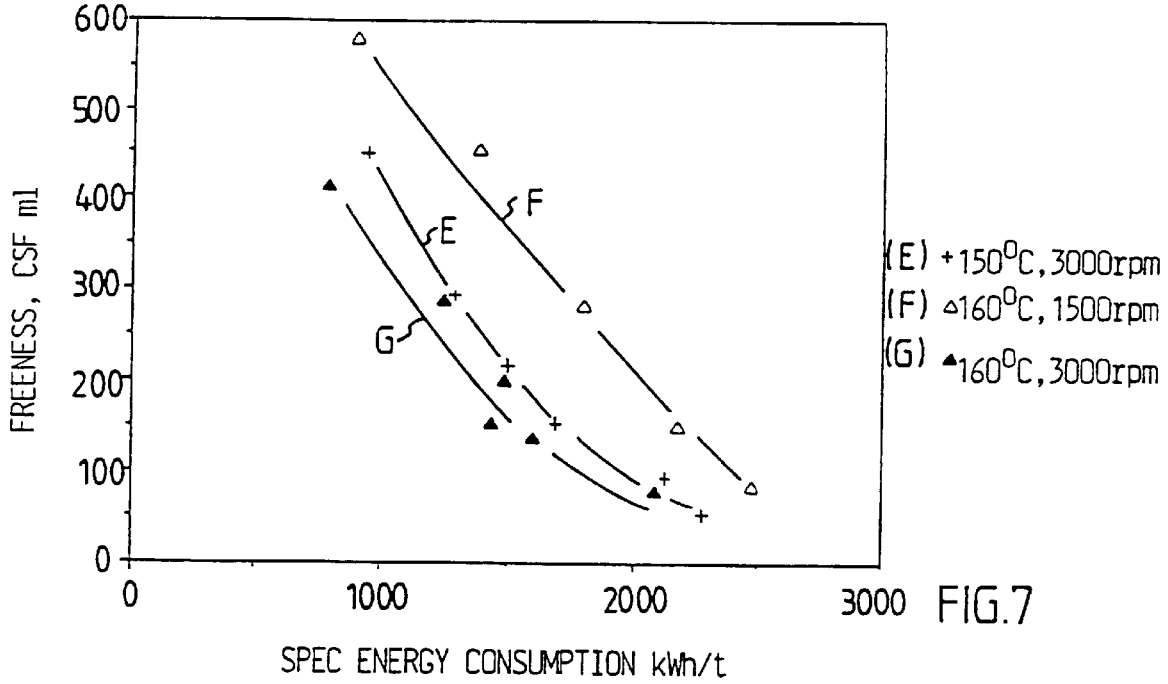
FIG. 7 is a graph of freeness as a function of the energy consumption.
Figure 8:
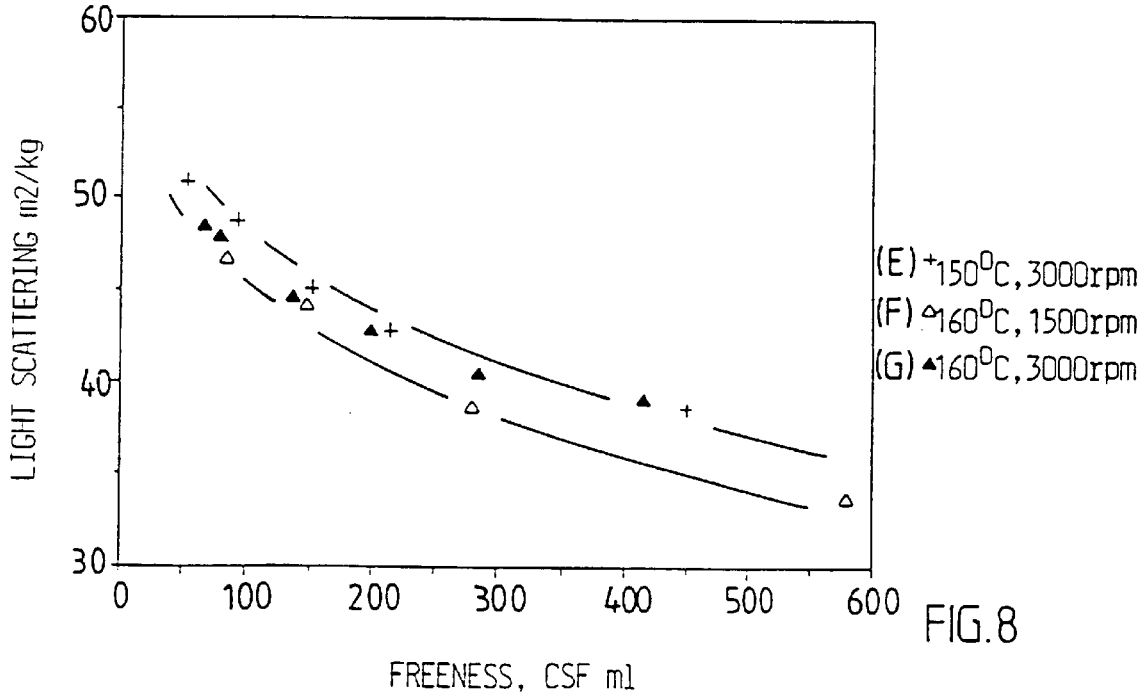
FIG. 8 is a graph of the light scattering coefficient of the pulp as a function of freeness.

The effect of the varying conditions on energy consumption and light scattering capacity appears from FIGS. 7 and 8, which show freeness as a function of energy consumption and, respectively, light scattering as a function of freeness.

FIG. 7 shows that the energy consumption is considerably higher when the TMP-process is initiated with a refining step at a temperature above the softening temperature of lignin than that obtained with conditions according to the invention (compare FIG. 1).

FIG. 8 shows that the light scattering coefficient is considerably lower when the TMP-process is initiated with a refining step at temperatures above the softening temperature of lignin than that obtained with conditions according to the invention (compare FIG. 6). The pulps produced according to the invention, therefore, are clearly most suitable for use as printing paper pulps, where just the light scattering coefficient must be sufficiently high for achieving the desired optical properties.

The example described proves clearly, that mechanical pulp can be produced with the conditions of the invention at low energy consumption, at the same time as essential properties like shives content, long fiber content, tear strength, tensile strength and light scattering meet high requirements on this type of pulps. The energy consumption at the production of newsprint, for example, can be reduced by about 40% compared with conventional manufacturing methods.

In the process according to the invention, chemicals can be added advantageously after or during the first refining step, in order to avoid dark colouring at the high temperatures above the softening temperature of lignin in subsequent refining steps. The chemicals also can have a bleaching effect.

Examples of such chemicals are sodium sulphite, sodium bisulphite, sodium ditionite, peroxide etc.

According to the invention, the initial processing can be carried out, besides in refiners, also in grinders, compressing screws or other mechanical processing equipment.

In cases when a reject fraction separated from the processed material is subjected to additional mechanical processing, this reject with a temperature above the softening temperature of lignin shall be fed into at least one subsequent processing step.

The invention, of course, is not restricted to the examples shown, but can be varied within the scope of the invention idea.

We claim:

1. A method for producing pulp from lignocellulose-containing fibrous material with a yield of greater than about 85% comprising: feeding said lignocellulose-containing fibrous material to a first refining step conducted at a first temperature less than the softening temperature of lignin, mechanically processing said lignocellulose-containing fibrous material in said first refining step to produce a first refined lignocellulose-containing fibrous material, feeding said first refined lignocellulose-containing fibrous material to a second refining step conducted at a second temperature greater than the softening temperature of lignin, and mechanically processing said first refined lignocellulose-containing fibrous material in said second refining step to produce said pulp.

2. The method of claim 1 wherein said pulp comprises a pulp selected from the group consisting of mechanical pulp and chemi-mechanical pulp.

3. The method of claim 1 wherein the difference between said first temperature and said second temperature is at least about 15° C.

4. The method of claim 3 wherein the difference between said first temperature and said second temperature is at least about 25° C.

5. The method of claim 4 wherein the difference between said first temperature and said second temperature is at least about 30° C.

6. The method of claim 1 wherein said lignocellulose-containing fibrous material comprises coniferous wood which has not been treated with chemicals, and wherein said second temperature is greater than about 150° C.

7. The method of claim 6 wherein said second temperature is greater than about 160° C.

8. The method of claim 7 wherein said second temperature is greater than about 170° C.

9. The method of claim 1 wherein said lignocellulose-containing fibrous material has been treated with chemicals, and wherein said second temperature is greater than about 135° C.

10. The method of claim 9 wherein said second temperature is greater than about 150° C.

11. The method of claim 10 wherein said second temperature is greater than about 160° C.

12. The method of claim 1 including separating a reject fraction from said second refining step and subjecting said reject fraction to at least one additional processing step.

13. The method of claim 1 wherein said first refining step comprises treating said lignocellulose-containing fibrous material in a double-disk refiner.

14. The method of claim 13 wherein said double-disk refiner rotates at a speed of at least about 1200 rpm.

15. The method of claim 1 wherein said first refining step comprises treating said lignocellulose-containing fibrous material in a single-disk refiner.

16. The method of claim 15 wherein said single-disk refiner rotates at a speed of at least about 1800 rpm.

17. The method of claim 16 wherein said single-disk refiner rotates at a speed of at least about 2400 rpm.

18. The method of claim 1 wherein said second refining step includes treating said lignocellulose-containing fibrous material in a refiner rotating at a speed of at least about 2400 rpm.

19. The method of claim 1 including adding chemicals for maintaining the brightness of said lignocellulose-containing fibrous material or bleaching said lignocellulose-containing fibrous containing material to said first refining step.

20. The method of claim 19 wherein said chemicals are selected from the group consisting of sodium sulphite, sodium bisulphite, sodium dithionite and peroxide.

21. The method of claim 20 wherein said chemicals are added subsequent to said first refining step.

* * * * *

UNITED STATES PATENT AND TRADEMARK OFFICE

CERTIFICATE OF CORRECTION

PATENT NO. : 5,853,534

DATED : December 29, 1998

INVENTOR(S) : Höglund et al.

It is certified that error appears in the above-identified patent and that said Letters Patent is hereby corrected as shown below:

Title page, item [75], after "Stockholm" insert, Bo Falk, Jarfalla--

Column 1, line 12, "The" should read --the--.

Column 2, line 41, before "DESCRIPTION" insert --BRIEF--.

Signed and Sealed this

Eighteenth Day of May, 1999

*Attest:*

Q. TODD DICKINSON

*Attesting Officer*

*Acting Commissioner of Patents and Trademarks*